US009313577B2

(12) United States Patent
Bodvarsson et al.

(10) Patent No.: US 9,313,577 B2
(45) Date of Patent: Apr. 12, 2016

(54) BINAURAL LISTENING SYSTEM WITH AUTOMATIC MODE SWITCHING

(71) Applicant: Oticon A/S, Smørum (DK)

(72) Inventors: Thorvaldur Oli Bodvarsson, Smørum (DK); Poul Henriksen, Smørum (DK)

(73) Assignee: OTICON A/S, Smorum (DK)

( * ) Notice: Subject to any disclaimer, the term of this patent is extended or adjusted under 35 U.S.C. 154(b) by 245 days.

(21) Appl. No.: 13/917,239

(22) Filed: Jun. 13, 2013

(65) Prior Publication Data

US 2014/0003636 A1 Jan. 2, 2014

Related U.S. Application Data

(60) Provisional application No. 61/662,366, filed on Jun. 21, 2012.

(30) Foreign Application Priority Data

Jun. 14, 2012 (EP) ..... 12172057

(51) Int. Cl.
*H04R 5/033* (2006.01)
*H04R 25/00* (2006.01)

(52) U.S. Cl.
CPC ..... *H04R 5/033* (2013.01); *H04R 25/552* (2013.01); *H04R 25/554* (2013.01); *H04R 25/558* (2013.01); *H04R 2460/03* (2013.01)

(58) Field of Classification Search
None
See application file for complete search history.

(56) References Cited

U.S. PATENT DOCUMENTS

| | | | |
|---|---|---|---|
| 6,823,195 | B1 | 11/2004 | Boesen |
| 2007/0274550 | A1 | 11/2007 | Baechler et al. |
| 2009/0087005 | A1 | 4/2009 | Reithinger |
| 2010/0184383 | A1 | 7/2010 | Lerke |
| 2013/0070946 | A1 | 3/2013 | Kroman |

FOREIGN PATENT DOCUMENTS

| | | | |
|---|---|---|---|
| EP | 2 211 579 | A1 | 7/2010 |
| WO | WO 2008/071807 | A2 | 6/2008 |
| WO | WO 2011/047707 | A1 | 4/2011 |

*Primary Examiner* — Thang Tran
*Assistant Examiner* — Mark Fischer
(74) *Attorney, Agent, or Firm* — Birch, Stewart, Kolasch & Birch, LLP

(57) ABSTRACT

Each listening device of a binaural listening system comprises a signal processing unit for processing a signal comprising audio and for performing logic actions based on one or more control inputs, and an antenna and transceiver unit for establishing said wireless link. The transceiver unit comprises a transmit control unit allowing the transmission of first data with a first level of transmission power providing a first operating transmission range and the transmission of second data with a second level of transmission power providing a second operating transmission range, wherein said second operating transmission range is larger than said first operating transmission range. Receive control units of the listening devices are adapted to extract the first control signal from the first data received from the respective opposite listening device.

18 Claims, 5 Drawing Sheets

BINAURAL LISTENING SYSTEM WITH AUTOMATIC MODE SWITCHING

CROSS REFERENCE TO RELATED APPLICATIONS

This non-provisional application claims the benefit under 35 U.S.C. §119(e) of U.S. Provisional Application No. 61/662,366 filed on Jun. 21, 2012 and under 35 U.S.C. §119 (a) of Patent Application No. 12172057.7 filed in Europe on Jun. 14, 2012. The entire content of all of the above applications is hereby incorporated by reference.

TECHNICAL FIELD

The present application relates to the field of portable listening devices, e.g. hearing aids, specifically binaural systems. The disclosure relates specifically to a binaural listening system comprising first and second listening devices adapted for being located at or in respective left and right ears of a user, the first and second listening devices comprising antenna and transceiver circuitry allowing an exchange of information between the listening devices.

The application furthermore relates to a method of operating a binaural listening system, and to the use of a binaural listening system.

The application further relates to a data processing system comprising a processor and program code means for causing the processor to perform at least some of the steps of the method.

Embodiments of the disclosure may e.g. be useful in applications comprising pairs of devices that are able communicate wirelessly with each other, e.g. hearing aids, ear phones, active ear protection systems, etc.

BACKGROUND

The following account of the prior art relates to one of the areas of application of the present application, hearing aids.

A Hearing Instrument (HI) user may have multiple disabilities and therefore shutting the hearing aids down for the night by opening the battery drawer (which is a typical way of powering down a hearing instrument to minimize unnecessary drain of the battery), can be a daily challenge. Alternatively, the user may just leave the hearing instruments in a drawer or on a table, while they are still on, resulting in lower battery life and possibly some feedback noise that might disturb relatives or pets (e.g. during the night).

US 2009/0087005 A1 describes a hearing aid system comprising two hearing aids between which a wireless signal transmission is provided. The hearing aids are automatically switched on and off. To this end, a field strength or value of an electromagnetic signal received by a hearing aid that is transmitted from the respective other hearing aid may be determined. The determined value is compared with a threshold value, the relevant hearing aid being switched off (sleep mode), as long as the field strength is greater than the threshold value and the hearing aid being switched on as long as the measured field strength is lower than the threshold value.

US 2010/0184383 A1 relates to a communication system comprising first and a second communication devices (e.g. a pair of hearing instruments of a binaural hearing aid system), each device comprising transmit and receive units for establishing a wireless link between the devices. At least the first communication device comprises a control unit for dynamically adjusting the transmit power of its transmit unit based on a measure of the quality of the link, wherein the system is adapted to use the dynamic transmit power regulation to implement a partial power-down mode of the system, when the two communication devices are expected NOT to be in a normal use.

SUMMARY

An object of the present application is to provide an improved binaural listening system. An object of the present application is to provide a binaural listening system adapted to conserve power.

Objects of the application are achieved by the invention described in the accompanying claims and as described in the following.

A Binaural Listening System:

In an aspect of the present application, an object of the application is achieved by a binaural listening system comprising first and second listening devices adapted for being located at or in respective left and right ears of a user, the first and second listening devices being adapted to establish a wireless link allowing an exchange of information between the listening devices, each listening device comprising

- a signal processing unit for processing a signal comprising audio and for performing logic actions based on one or more control inputs, and
- an antenna and transceiver unit for establishing said wireless link, the transceiver unit comprising
  - a transmit control unit allowing the transmission of first data with a first level of transmission power providing a first operating transmission range and the transmission of second data with a second level of transmission power providing a second operating transmission range, wherein said second operating transmission range is larger than said first operating transmission range,
  - a receive control unit allowing the reception of said first and second data from an opposite listening device, when said first and second listening devices are located within said first and second operating transmission ranges, respectively, and wherein said transmit control units of said first and second listening devices are adapted to provide that said first data comprises a first control signal for performing a first action in said second and first listening device, respectively, and wherein said receive control units of said second and first listening devices are adapted to provide that said first control signal is extracted from said first data received from the respective opposite listening device, and wherein said signal processing units of said second and first listening devices, respectively, are adapted to perform said first action based on said first control signal.

This has the advantage of facilitating an automatic scheme for performing actions dependent on the current operating distance of two listening devices of a binaural listening system.

The term 'the opposite device' is in the present context taken to mean the other device of the binaural listening system relative to the currently described device, i.e. 'the opposite device' to the first listening device is the second listening device and vice versa. The first control signal is preferably fed to the signal processing unit as one of the one or more control inputs.

It is to be understood that the binaural listening system is adapted to provide that first and second data are transmitted from the first listening device and received in the second listening device (if transmission ranges are appropriate) and that first and second data are transmitted from the second listening device and received in the first listening device (if transmission ranges are appropriate). Consequently, a first (or second) control signal may, when transmitted from the first listening device, result in a first (or second) action being carried out by the signal processing unit of the second listening device (and vice versa).

In a particular embodiment, the transmit control units of the first and second listening devices are adapted to provide that the second data comprises a second control signal for performing a second action in the second and first listening devices, respectively, and wherein the receive control units of the second and first listening devices are adapted to provide that the second control signal is extracted from the second data received from the respective opposite listening device, and wherein the signal processing units of the second and first listening devices, respectively, are adapted to perform the second action based on the second control signal.

In a particular embodiment, the receive control unit of the second and first listening device is adapted to generate a third control signal in case the first control signal has not been received and extracted for a predefined time or according to a predefined scheme, and wherein the signal processing units of the second and first listening devices, respectively, are adapted to perform a third action based on the third control signal.

In an embodiment, the first action comprises activating a specific mode of operation.

In a particular embodiment, the first action comprises activating (or maintaining) a microphone-off mode, where a microphone or the microphone system of the listening device is turned off. Thereby feedback can be avoided, and power saved compared to a situation where feedback howl persists over a prolonged period of time (e.g. between uses of the hearing aid system, typically during a user's sleep or resting period(s), e.g. overnight).

In a particular embodiment, the first action comprises activating (or maintaining) a low-power mode of operation. In an embodiment, the low-power mode of operation comprises a 'partial power down' of the listening device, a 'partial power down' being taken to mean that the power consumption of the device is reduced substantially compared to a normally operating state or mode of the device (e.g. an average power consumption over a predefined period, e.g. during a day's use), such as down to 20% of normal, such as down to 10% of normal, such as down to 5% of normal, such as down to 1% of normal. The binaural listening system is adapted to at least allow the transmit control unit and the receive control unit of the transceiver unit to transmit and receive, respectively, the first control signal while in the low-power (or sleep) mode.

In a particular embodiment, each listening device is adapted to be switched in a complete power off-mode (or at least in a power-down mode that consumes less power than the low-power-mode described in the present disclosure), either automatically based on a decision taken in the listening device in question or by a command received in a given listening device, e.g. from a user interface (e.g. via an activation element on the listening device or via a remote control device), or based on a control input from an external device and/or sensor.

In a particular embodiment, the second action comprises activating (or maintaining) a normal mode of operation.

In a particular embodiment, the third action comprises activating (or maintaining) a normal mode of operation.

In a particular embodiment, at least one of the first and second listening devices comprises an activation element allowing to manually activate a normal mode of operation (when the listening device is in a low-power mode or in a fully powered down ('off') state). In an embodiment, the binaural system comprises a remote control allowing a user to manually activate a normal mode of operation (including bringing the listening device(s) out of a low-power mode, e.g. turning the system 'on').

In an embodiment, the normal mode of operation comprises a mode where the listening system is worn by the user in an operational state, e.g. turned on and in a state to provide the functionality a user would expect from the device during normal use.

In an embodiment, the transmit control unit is adapted to provide that the first control signal is transmitted according to a first timing scheme. In an embodiment, the first timing scheme comprises that the first control signal is transmitted at first predefined intervals in time (with a first transmit frequency), e.g. every 30 seconds. In an embodiment, the first timing scheme of the first listening device is equal to the first timing scheme of the second listening device. In an embodiment, the first timing scheme is different in the first and second listening devices. In an embodiment, the first timing scheme of the first and/or second listening device depends on the mode of operation of the device in question. In an embodiment, the first timing scheme of the device in question is different when the device is in the low-power mode from when the device is in a normal mode of operation.

In an embodiment, the first control signal is transmitted during the low-power mode as well as during the normal mode(s) of operation of the binaural listening system.

In an embodiment, the transmit control unit is adapted to provide that the second control signal is transmitted according to a second timing scheme. In an embodiment, the second timing scheme comprises that the second control signal is transmitted at second predefined intervals in time (with a second transmit frequency), e.g. every 30 seconds. In an embodiment, the first and second timing schemes are identical. In an embodiment, the first and second timing schemes are different. In an embodiment, the first transmit frequency is larger than the second transmit frequency. In an embodiment, the second timing scheme of the first listening device is equal to the second timing scheme of the second listening device. In an embodiment, the second timing scheme is different in the first and second listening devices.

In an embodiment, the first transmission range is smaller than the smallest distance between the first and second listening devices, when used in normal operation. In an embodiment, the first transmission range is smaller than 10 cm, e.g. smaller than 5 cm.

In an embodiment, the second transmission range is larger than the smallest distance between the first and second listening devices, when used in normal operation. In an embodiment, the second transmission range is larger than 10 cm, e.g. larger than 12 cm. In an embodiment, the second transmission range is smaller than 100 cm, e.g. smaller than 50 cm.

In an embodiment, the first and/or second transmission ranges have respective minimum operating frequencies, below which the first and/or second control signals, respectively, cannot be extracted properly in the receiver of the respective listening devices (e.g. due to saturation of the receiver (too large transmit power for the current transmitter-to-receiver distance)). In an embodiment, the first operating transmission range ($\Delta L_1$) is a range between a minimum ($L_{1min}$) and a maximum ($L_{1max}$) distance between the first and second listening devices. In an embodiment, the second operating transmission range ($\Delta L_2$) is a range between a minimum ($L_{2min}$) and a maximum ($L_{2max}$) distance between the first and second listening devices. In an embodiment, the first and second operating transmission ranges overlap. In an embodiment, the second operating transmission range includes the first operating transmission range. In an embodiment, the first and second operating transmission ranges do not overlap.

In an embodiment, the transmit control unit of the first and second listening device is adapted to send a first information signal to the second and first listening devices, respectively, when the first and second listening device, respectively, have received the first control signal. In an embodiment, the signal processing units of the second and first listening devices, respectively, are adapted to perform the first action based on the first control signal and the first information signal received from their respective opposite listening devices In other words, the first control signal has to be received (simultaneously, i.e. e.g. within the predefined intervals in time between subsequent transmissions of the first control signals, and/or a predefined number of times) in both listening devices before the first action is initiated in either of the two listening devices.

In an embodiment, the first and second listening devices are authorized to allow an exchange of data between them. In an embodiment, such authorization is provided in an initial pairing process, e.g. involving an identification key, where one or more authorized devices that are allowed to communicate with the listening device in question (at least the opposite listening device) may be defined. In an embodiment, the transmit unit is adapted to issue an identification key with the first and second data, e.g. the first and second control signal. In an embodiment, the receive unit is adapted to recognize an identification key received in the first or second data from an authorized device and to only extract the first or second control signals received from an authorized device.

In an embodiment, the first and/or second listening device is adapted to provide functionality of a hearing aid, e.g. to provide a frequency dependent gain to compensate for a hearing loss of a user. In an embodiment, the signal processing unit is adapted for enhancing input audio signals and providing a processed output signal. Various aspects of digital hearing aids are described in [Schaub; 2008].

In an embodiment, the first and/or second listening device comprises an output transducer, e.g. a receiver (speaker), for converting a processed electric output signal to an output sound.

In an embodiment, the first and/or second listening device comprises an input transducer (e.g. a microphone) for converting an input sound to an electric input signal. In an embodiment, the first and/or second listening device comprises a directional microphone system adapted to enhance a target acoustic source among a multitude of acoustic sources in the local environment of the user wearing the listening device.

The listening device comprises an antenna and transceiver circuitry for wirelessly receiving an electromagnetic signal and providing an electric input signal from another device, e.g. a communication device or another listening device. In an embodiment, the electric input signal represents or comprises an audio signal and/or a control signal (e.g. for setting an operational parameter (e.g. volume) and/or a processing parameter of the listening device) and/or an information signal (e.g. relating to a status of another device, e.g. to contribute to decide on an action to take in the receiving listening device). In an embodiment, the listening device comprises demodulation circuitry for demodulating the received electromagnetic signal to provide the electric input signal representing an audio signal and/or a control and/or information signal. In general, the wireless link established by a transmitter and antenna and transceiver circuitry of the listening device can be of any type. In an embodiment, the wireless link is used under power constraints, e.g. in that the listening device comprises a portable (typically battery driven) device. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the listening devices comprise two different wireless links. In an embodiment, the first data are transmitted via a short range link (e.g. based on inductive coupling between adjacent inductor coils), while the second data are transmitted via a longer range link (e.g. based on radiated fields).

In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying) or QAM (quadrature amplitude modulation).

In an embodiment, the communication between a listening device and another device (e.g. the other listening device) is in the base band (audio frequency range, e.g. in the range between 0 and 20 kHz). Preferably, communication between the listening device and the other device (e.g. the other listening device) is based on some sort of modulation at frequencies above 100 kHz. Preferably, frequencies used to establish communication between the listening device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range.

In an embodiment, the first and/or second listening device comprises an electrically small antenna. An 'electrically small antenna' is in the present context taken to mean that the spatial extension of the antenna (e.g. the maximum physical dimension in any direction) is much smaller than the wavelength $\lambda_{Tx}$ of the transmitted electric signal. In an embodiment, the spatial extension of the antenna is a factor of 10, or 50 or 100 or more, or a factor of 1 000 or more, smaller than the carrier wavelength $\lambda_{Tx}$ of the transmitted signal. In an embodiment, the listening device is a relatively small device. The term 'a relatively small device' is in the present context taken to mean a device whose maximum physical dimension (and thus of an antenna for providing a wireless interface to the device) is smaller than 10 cm, such as smaller than 5 cm. In an embodiment 'a relatively small device' is a device whose maximum physical dimension is much smaller (e.g. more than 3 times, such as more than 10 times smaller, such as more than 20 times small) than the operating wavelength of a wireless interface to which the antenna is intended (ideally an antenna for radiation of electromagnetic waves at a given frequency should be larger than or equal to half the wavelength of the radiated waves at that frequency). At 860 MHz, the wavelength in vacuum is around 35 cm. At 2.4 GHz, the wavelength in vacuum is around 12 cm. In an embodiment, the listening device has a maximum outer dimension of the order of 0.15 m (e.g. a handheld mobile telephone). In an embodiment, the listening device has a maximum outer dimension of the order of 0.08 m (e.g. a head set). In an embodiment, the listening device has a maximum outer dimension of the order of 0.04 m (e.g. a hearing instrument).

In an embodiment, the first and second listening devices are portable devices, e.g. devices comprising a local energy source, e.g. a battery, e.g. a rechargeable battery. In an embodiment, the local energy source has a maximum capacity of 1000 mAh, such as 500 mAh, which—without being exchanged or recharged—provides an operating time of the listening device (in a normal mode of operation) of the order of hours or days, e.g. maximum 1 or 3 or 7 or 10 days.

In an embodiment, the first and/or second listening device comprise(s) a forward or signal path between an input transducer (microphone system and/or a direct electric input (e.g. a wireless receiver)) and an output transducer (e.g. a loudspeaker). In an embodiment, the signal processing unit is located in the forward path. In an embodiment, the signal processing unit is adapted to provide a frequency dependent gain according to a user's particular needs. In an embodiment, the listening device comprises an analysis path comprising functional components for analyzing the input signal or a signal from the forward path (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the listening devices comprise an analogue-to-digital (AD) converter to digitize an analogue input with a predefined sampling rate, e.g. 20 kHz. In an embodiment, the listening devices comprise a digital-to-analogue (DA) converter to convert a digital signal to an analogue output signal, e.g. for being presented to a user via an output transducer and/or transmitted to another device.

In an embodiment, the first and/or second listening device further comprise(s) other relevant functionality for the application in question, e.g. compression, noise reduction, etc.

In an embodiment, the first and/or second listening device comprise(s) a hearing aid, e.g. a hearing instrument, e.g. a hearing instrument adapted for being located at the ear or fully or partially in the ear canal of a user, e.g. a headset, an earphone, an ear protection device or a combination thereof.

In an embodiment, the binaural listening system further comprises an auxiliary device. In an embodiment, the system is adapted to establish a communication link between the listening device and the auxiliary device to provide that information (e.g. control and status signals, possibly audio signals) can be exchanged or forwarded from one to the other. In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the listening device. In an embodiment, the auxiliary device is or comprises a remote control for controlling functionality and operation of one or both listening device(s) of the binaural listening system.

In an embodiment, the binaural listening system further comprises a container for storing the listening devices of the binaural listening system. In an embodiment, the container is adapted to provide that the first level of transmission power is sufficient to allow the first control signal to be received and extracted from the first data in each of the first and second listening devices when the devices are located in the container. Thereby a safe storage is ensured and power may be maintained (if the first control signal is used to perform the action of bringing the devices in question into a low-power mode). In an embodiment, the container comprises a layer or coating that reflects the electromagnetic waves from the antenna of a listening device in question. Thereby the strength of the electromagnetic signal (for a given transmission power) is maximized at the receiver. In an embodiment, the container has a form and dimensions that are adapted to ensure that the first and second listening devices are within the first operating transmission range when the devices are located in the container.

Use:

In an aspect, use of a binaural listening system as described above, in the 'detailed description of embodiments' and in the claims is moreover provided. In an embodiment, use in a system comprising a binaural hearing aid system comprising two hearing instruments, ear phones, active ear protection systems, etc., or combinations thereof, is provided.

A Method:

In an aspect, a method of operating a binaural listening system, the binaural listening system comprising first and second listening devices adapted for being located at or in respective left and right ears of a user, the first and second listening devices being adapted to establish a wireless link allowing an exchange of information between the listening devices is furthermore provided by the present application. The method comprises

- processing a signal comprising audio and performing logic actions based on one or more control inputs, and
- establishing said wireless link, while
  - allowing the transmission of first data with a first level of transmission power providing a first operating transmission range and the transmission of second data with a second level of transmission power providing a second operating transmission range, wherein said second operating transmission range is larger than said first operating transmission range, said transceiver unit further comprising
  - allowing the reception of said first and second data, when said first and second listening devices are located within said first and second operating transmission ranges, respectively,
- providing that said first data comprises a first control signal for performing a first action in said second and first listening device, respectively, and
- providing that said first control signal is extracted from said first data received from the respective opposite listening device, and
- performing said first action based on said first control signal.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding system.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Figure 1A:
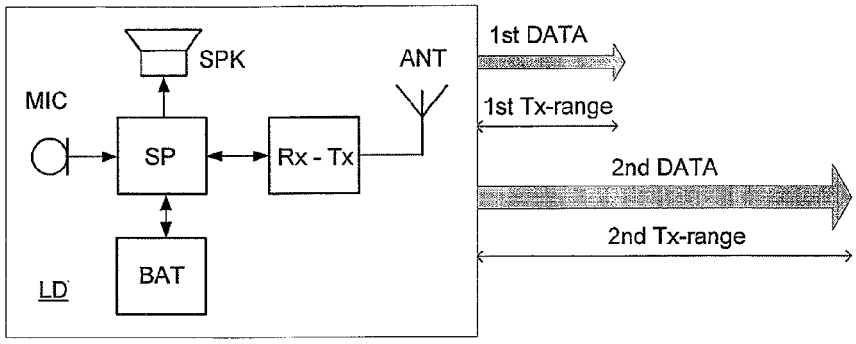
FIG. 1A shows an embodiment of a listening device, which may form part of a binaural listening system

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Instead of opening the battery drawer of a portable listening device (e.g. a hearing aid) to save power or just letting the listening devices be left in an on-state for the night, a low-power or sleep mode is activated by putting the devices of a binaural listening system in close proximity.

A solution is proposed, where a wireless interface of a listening device, e.g. a hearing instrument (HI), is used to detect whether the listening devices of a binaural system (e.g. a binaural hearing aid system) are in close proximity of each other. A low-power signal (with a first level of transmission power) is sent from each listening device, according to a predefined scheme, e.g. at predefined intervals in time (e.g. every 30 seconds). The low-power signal has a predefined (first operating transmission) range (e.g. a maximum range of 5 cm). The low-power signal comprises a first control signal (command) instructing a (selected, specific) receiver receiving the low-power signal to perform an action. When the low-power signal is detected in one or both hearing instruments, the hearing instrument(s) in question may e.g. be adapted enter a sleep mode with reduced power consumption. In an embodiment, the binaural listening system is adapted so that the low-power signal has to be received in both listening devices before the sleep mode is activated in either of the two listening devices. The sleep mode is adapted to still allowing the low-power signal to be transmitted and received when the listening devices of the binaural system are within the predefined maximum range for low-power communication. The listening devices that together constitute a binaural listening system are preferably adapted to know each other (e.g. in an initial pairing process, e.g. involving an identification key) where one or more authorized devices that are allowed to communicate with the listening device in question is defined. Transmitting devices of the listening system are preferably adapted to identify themselves vis-à-vis other devices. Receiving devices of the listening system are preferably adapted to only accept information from known devices. The listening devices are adapted to stay in a sleep mode as long as the low-power signal is present (detected). The low transmission range of the low-power signal prevents a listening device (e.g. a hearing instrument) from going into sleep mode while in use (a lowest distance between two ears, e.g. of a child, is about 12 cm). When the low-power signal no longer received by a given listening device of a binaural system (as an indication that the devices are no longer in close proximity), it will leave the sleep mode and activate a normal mode, e.g. entering the program that is normally used at start-up (or the last program that was used before the sleep mode was entered). In sleep mode the microphones, receivers and most DSP processes are e.g. shut down, saving up to 99% of power (compared to a normal operation). In an embodiment, the listening device is adapted to transmit the low-power signal according to a predefined scheme, e.g. with a predefined frequency. In an embodiment, the listening device is adapted to transmit the low-power signal with a predefined normal mode-frequency when the listening device is in normal mode of operation. In an embodiment, the listening device is adapted to transmit the low-power signal with a predefined sleep mode-frequency when the listening device is in sleep mode. In an embodiment, the normal mode-frequency is smaller than the sleep mode-frequency. In an embodiment, the normal mode-frequency is larger than the sleep mode-frequency. In an embodiment, the normal mode-frequency and/or the sleep mode-frequency are configurable, e.g. user configurable (e.g. via a user interface on the listening device(s) and/or via a remote control of the listening device(s)).

Figure 1B:
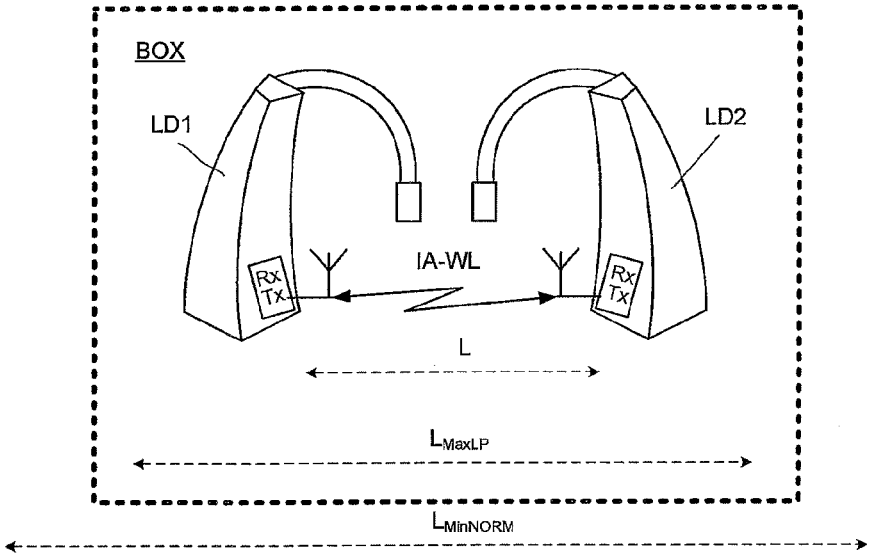
FIGS. 1B and 1C show an embodiment of a binaural listening system comprising first and second listening devices.
Figure 1C:
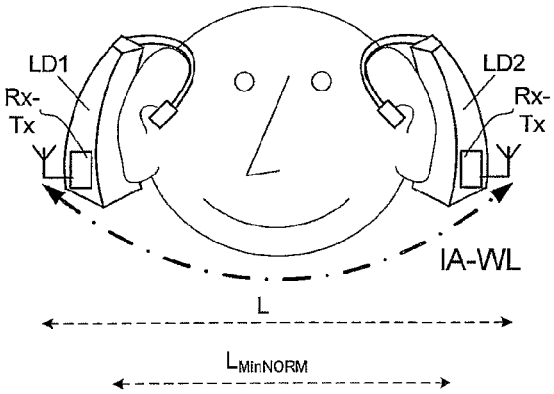

FIG. 1A shows an embodiment of a listening device, which may form part of a binaural listening system according to the present disclosure and FIGS. 1B and 1C show an embodiment of a binaural listening system comprising first and second listening devices (each e.g. as shown in FIG. 1A).

FIG. 1A shows a listening device (LD), e.g. a hearing aid, comprising a forward path from an input transducer (MIC) (e.g. a microphone or a microphone system) to an output transducer (SPK) (e.g. a loudspeaker), the forward path being defined there between and comprising a processing unit (SP) for performing logic actions based on one or more control inputs and for processing a signal picked up by the input transducer (or a signal originating there from), e.g. for applying a frequency dependent gain to the signal, and for providing an enhanced signal to the output transducer. The forward path may further comprise analogue-to-digital (AD) and digital-to-analogue (DA) converters allowing digital signal processing in the forward path to be performed. The listening device (LD) further comprises a local source of energy (BAT), e.g. a battery, for energizing some or all of the functional components of the device. The processing unit (SP) is adapted—based on one or more control input signals (e.g. a first control signal from an opposite listening device of a binaural listening system)—to perform or initiate logic actions related to the drain on the battery (BAT), e.g. by providing control signals that initiate the switching of various functional components on or off. Alternatively or additionally, the local source of energy (BAT) may comprise a control unit (cf. unit CNT in FIG. 4) allowing various functional parts of the listening device (e.g. the microphone system, parts of the signal processing, etc.) to be selectively powered down (or up) based on one or more control signals from the processing unit (SP) (cf. control signal PCT in FIG. 4). The listening device (LD) further comprises an antenna (ANT) and transceiver unit (Rx-Tx) for establishing a wireless link (cf. e.g. IA-WL in FIG. 1B, 1C) to another device, e.g. a second listening device of a binaural listening system (cf. LD2 in FIG. 1B, 1C). The transceiver unit (Rx-Tx) comprises a transmit control unit allowing the transmission of first data with a first level of transmission power providing a first operating transmission range ($1^{st}$ Tx-range) e.g. less than 7 cm, and the transmission of second data with a second level of transmission power providing a second operating transmission range ($2^{nd}$ Tx-range), e.g. at least 12 cm. The second operating transmission range is larger than the first operating transmission range allowing a distance dependent control scheme to be implemented. The transceiver unit (Rx-Tx) further comprises a receive control unit allowing the reception of the first and second data, when the first and second listening devices are located within the first and second operating transmission ranges, respectively (FIGS. 1B and 1C illustrating situations wherein the mutual distances of listening devices LD1 and LD2 of a binaural listening system are within the first ($1^{st}$ Tx-range) and second ($2^{nd}$ Tx-range) operating transmission range, respectively). The second operating transmission range ($2^{nd}$ Tx-range) may or may not include the first operation transmission range ($1^{st}$ Tx-range). The transmit control unit of the listening device is adapted to insert a first control signal for performing a first action (in the opposite listening device) in the first data stream. The receive control units of the listening device is adapted to extract the first control signal from said first data received from the respective opposite listening device, and wherein said signal processing units of said second and first listening devices, respectively, are adapted to perform said first action (e.g. powering down or up of functional parts of the listening device) based on said first control signal. The (inter-aural) wireless link (cf. IA-WL in FIG. 1B, 1C) is preferably an inductive link based on an inductive coupling between antenna coils of the transmitter and receiver parts of the respective listening devices (i.e. preferably, the antenna (ANT in FIG. 1A) is an inductor coil). Alternatively, the wireless link may be based on far-field, electromagnetic radiation (e.g. at frequencies above 100 MHz, e.g. above 1 GHz).

FIG. 1B and FIG. 1C show two different situations (locations) of the two listening devices (LD1, LD2) of a binaural listening system. In both situations, the binaural hearing aid system comprises first and second listening devices (LD1, LD2) adapted for being located at or in left and right ears of a user, when in operating use. The listening devices are adapted for exchanging information between them via a wireless communication link, e.g. a specific inter-aural (IA) wireless link (IA-WL). The two listening devices (LD1, LD2) are adapted to allow the exchange of status signals, e.g. including the first and second control signals. To establish the inter-aural link (IA-WL), each hearing instrument comprises antenna and transceiver circuitry (here indicated by antenna symbol and block IA-Rx/Tx). The listening devices LD1 and LD2 are preferably embodied in a listening device LD as described in connection with FIG. 1A.

FIG. 1B shows a situation where the two listening devices (LD1, LD2) of the binaural listening system are located in a container (BOX) for storing the listening devices of the binaural listening system. The container is adapted (e.g. in dimensions, form, design and materials) to provide that the first level of transmission power is sufficient to allow the first control signal to be received and extracted from the first data in each of the first and second listening devices (LD1, LD2) when the devices are located in the container. In an embodiment, the container has a form and dimensions that are adapted to ensure that the first and second listening devices (LD1, LD2) are within the first operating transmission range ($1^{st}$ Tx-range of FIG. 1A) when the devices are located in the container. The maximum operating transmission distance where first data can be safely received in a listening device of a binaural listening system from the opposite listening device is indicated by $L_{MaxLP}$ in FIG. 1B. At this distance or below, it is assumed that the binaural listening system is NOT in normal operation use. The container (BOX) is preferably adapted to ensure that the distance between the listening devices is smaller than $L_{MaxLP}$ when the devices are located in the container. The actual distance between the two listening devices (LD1, LD2) in their current positions of the container (BOX) is indicated by L in FIG. 1B (here $L<L_{MaxLP}$). The minimum operating transmission distance where the binaural listening system is assumed NOT to be in a non-operational state is indicated by $L_{MinNORM}$ in FIG. 1B. The binaural listening system is adapted to provide that $L_{MinNORM}$ is larger than $L_{MaxLP}$, e.g. at least 5 cm larger. At this distance or above, it is assumed that the binaural listening system is in normal operation use (although they may be in a situation where the devices are too far from each other to be able to receive the second data (or other data transmitted with a higher level of transmit power)).

FIG. 1C shows a situation where the two listening devices (LD1, LD2) of the binaural listening system are located in an operational mode at the ears of a user. The actual distance between the two listening devices (LD1, LD2) in their current positions at the head of the user is indicated by L in FIG. 1C (here $L>L_{MinNORM}$).

Figure 2A:
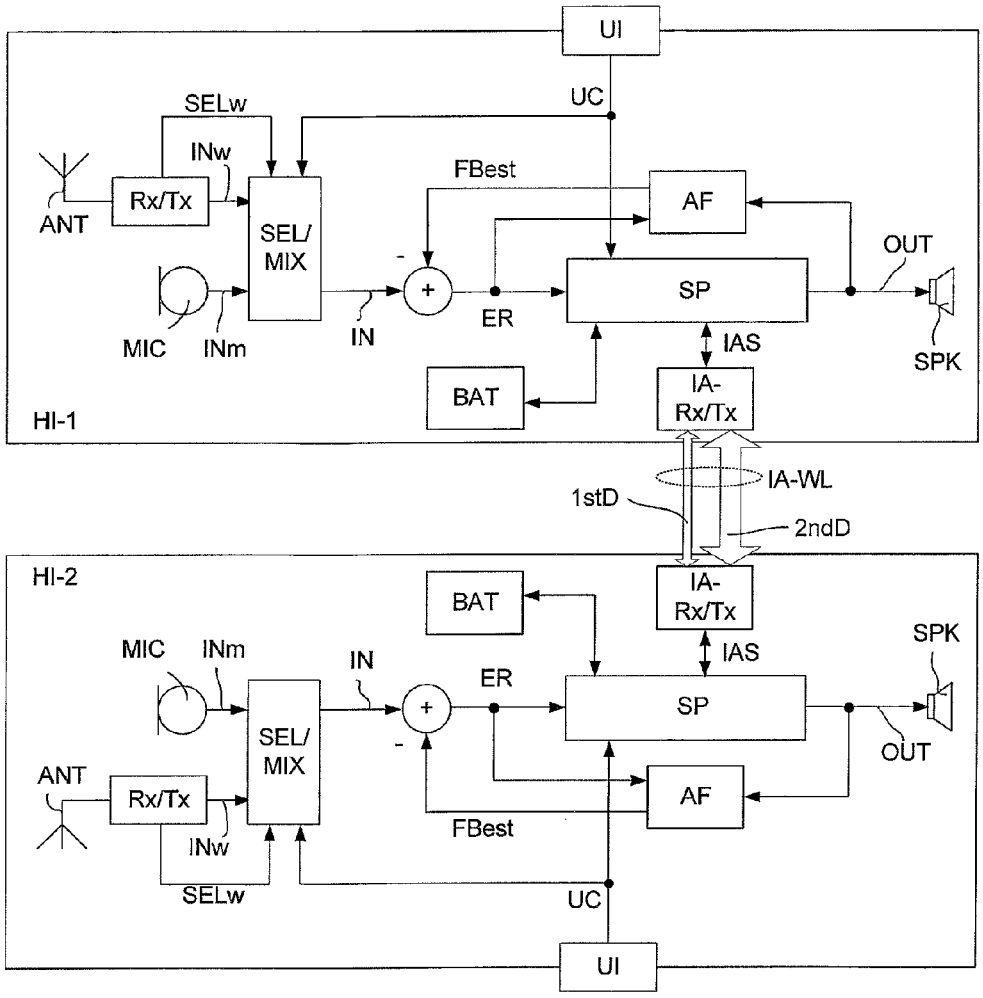
FIGS. 2A-2B show two embodiments of a binaural hearing aid system comprising first and second hearing instruments.
Figure 2B:
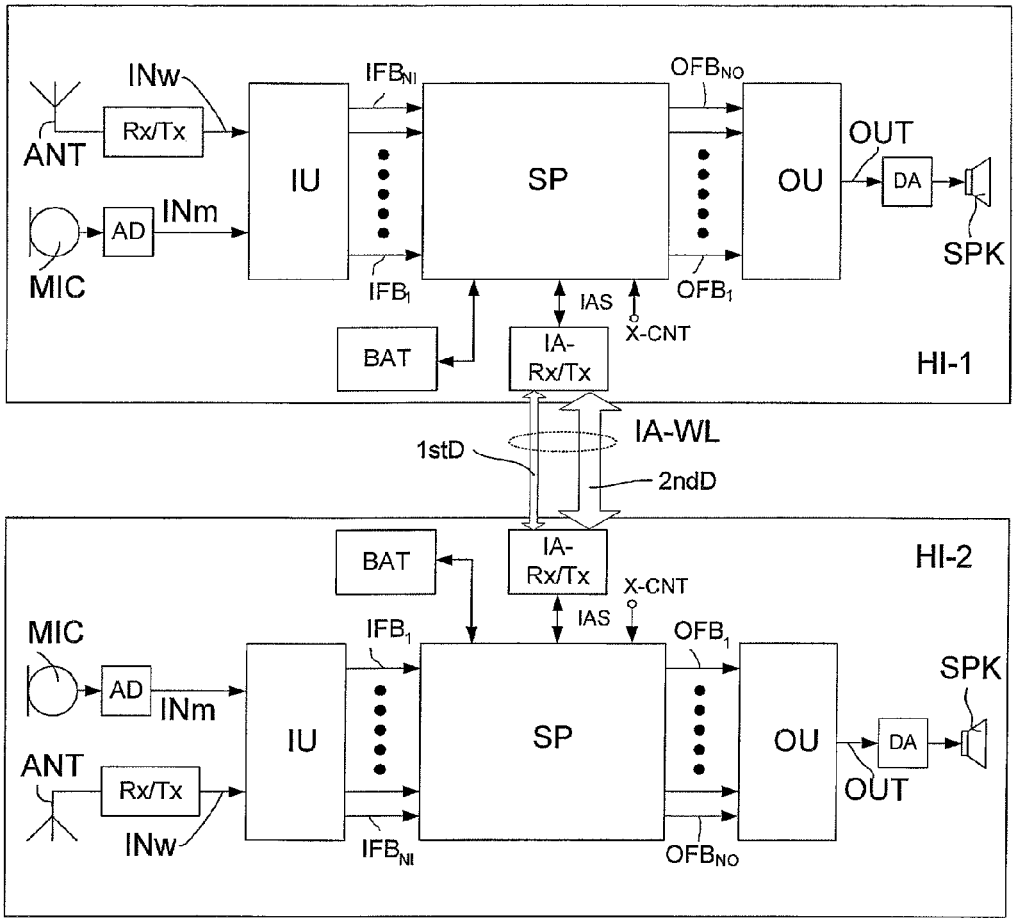

FIGS. 2A-2B shows two embodiments of a binaural hearing aid system comprising first and second hearing instruments. The embodiments of a binaural hearing aid system shown in FIGS. 2A and 2B each comprises first and second hearing instruments (HI-1, HI-2) adapted for being located at or in left and right ears of a user. The hearing instruments (HI-1, HI-2) each comprise the functional components (microphone (MIC), loudspeaker (SPK) signal processing unit (SP) battery (BAT) and an inter-aural (IA) wireless link (IA-WL, IA-Rx/Tx) for exchanging first (1stD) and second data (2ndD) as explained in connection with FIGS. 1A-1C. Additionally, the hearing instruments of FIGS. 2A and 2B each comprises a further wireless interface for establishing a wireless link to another device (e.g. the other listening device of the binaural system and/or any other communication device, e.g. a mobile telephone, an audio entertainment device, an audio gateway device, or a remote control device, etc.). The further wireless interface is implemented by antenna (ANT) and transceiver circuitry (Rx/Tx) providing an extracted signal (INw e.g. comprising audio and/or control/information signals) to the signal path and/or the signal processor (SP) of the hearing instrument in question.

In the embodiment of a binaural hearing aid system of FIG. 2A, the extracted signal INw from the further wireless interface (ANT, Rx/Tx) is fed to a selector or mixer unit (SEL/MIX) in parallel to the input signal INm from the microphone (or microphone system) (INm comprising an audio signal picked up from the surrounding of the hearing instrument in question). The output IN of the selector or mixer unit (SEL/MIX) presents a resulting audio input signal in the form of the microphone signal INm or the wirelessly received audio signal INw or a mixture thereof. The selection or mixture of the signals may e.g. be controlled by control signal UC generated via user interface (UI) (e.g. an activation element on the hearing instrument or a signal received from a remote control device). The selector mixer unit (SEL/MIX) may further be controlled by a control signal SELw extracted from the signal received via the further wireless interface (ANT, Rx/Tx). The hearing instruments (HI-1, HI-2) further comprises a feedback cancellation system comprising a feedback estimation unit (AF) for providing an estimate FBest of the feedback from the speaker output to the microphone input and a subtraction unit ('+') for subtracting the feedback estimate FBest from the resulting audio input signal IN (only relevant if the resulting audio input signal IN solely or mainly originates from the microphone input signal INm; if this is not the case, the feedback estimation unit (AF) is preferably deactivated). The output signal ER of the subtraction unit ('+'), representing a feedback corrected input signal ('the error signal'), is fed to the signal processing unit (SP) for further enhancement (e.g. application of a frequency dependent gain according to a user's hearing impairment) and to the feedback estimation unit (AF) together with the output (or 'reference') signal OUT from the signal processing unit (SP). The processing of the audio signal of the forward path of the hearing instruments between the input transducer (MIC or (ANT, Rx/Tx)) and the output transducer (SPK) is e.g. performed partially of fully in the time domain. The first (1stD) and second data (2ndD) are generated in the signal processing unit (SP) and forwarded to the inter-aural wireless link (IA-WL, IA-Rx/Tx) for transmission to the respective other hearing instrument.

Compared to the embodiment of a binaural hearing aid system of FIG. 2A, the embodiment of FIG. 2B comprises a further control input signal X-CNT to the signal processing unit (SP). The further control input(s) X-CNT may e.g. originate from a sensor forming part of or connected to the hearing instrument in question. The further control signal(s) may preferably be used together with the first (and possibly second) control signals to influence a decision in the hearing instrument in question (e.g. to initiate a power-on or (partial) power-down action (to enter a low-power mode)). The control signals from the local and the opposite hearing instrument are e.g. used together, to influence a decision or a parameter setting in the local hearing instrument. The further (local) control signals may e.g. comprise information relating to a classification of the current acoustic environment (or other parameters of the environment) of the hearing instruments (e.g. level of feedback, level of audio input signal, movement of the instrument, etc.). The embodiment of FIG. 2B further indicates a digital processing of the signal of the forward paths (cf. analogue-to-digital (AD) converter for digitizing the analogue input from the microphone (MIC) to thereby provide digital microphone signal INm) and digital-to-analogue (DA) converter to convert a digital signal (OUT) to an analogue output signal, e.g. for being presented to a user via loudspeaker (SP). The processing of the audio signal of the forward path of the hearing instruments (HI-1, HI-2) between the input transducer (MIC or (ANT, Rx/Tx)) and the output transducer (SPK) is performed partially of fully in the frequency domain (cf. band split signals $IFB_1, \ldots, IFB_{NI}$ from the input unit (IU) to the signal processing unit (SP) and $OFB_1, \ldots, OFB_{NO}$ from the signal processing unit (SP) to the output unit (OU)). In an embodiment, number of frequency bands (NI, NO) used for the processing of the audio signal is the same on the input side (NI) as on the output side (NO) of the signal processing unit (SP). The input and output units (IU and OU, respectively) are e.g. implemented as analysis and synthesis filter banks, respectively. The input unit (IU) receives input signals INm and INw from the microphone and the further wireless interface and provides a resulting (mixed or selected) band split input signal $IFB_1, \ldots, IFB_{NI}$. The output unit (OU) receives band split output signals $OFB_1, \ldots, OFB_{NO}$ from the signal processing unit (SP) and provides a resulting time domain output signal OUT.

Figure 3:
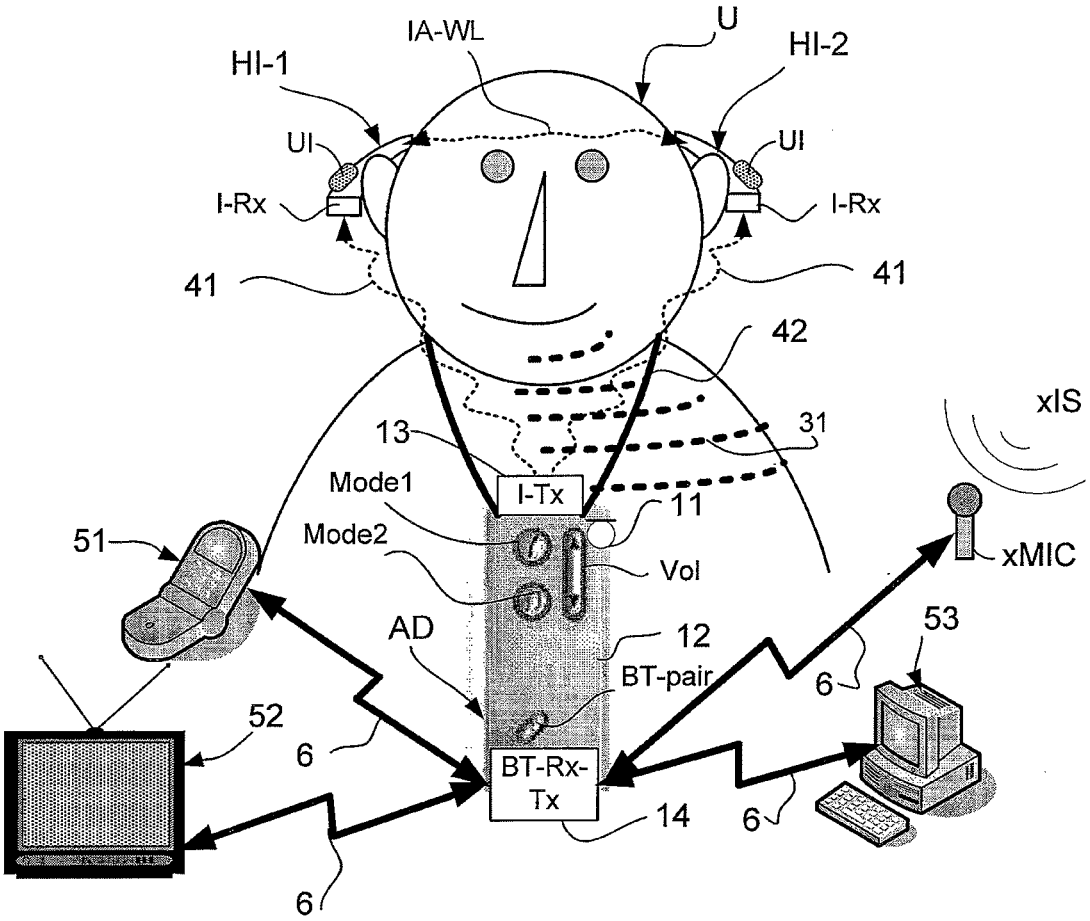
FIG. 3 shows an embodiment of a listening system comprising a binaural hearing aid system and an auxiliary device in the form of an audio gateway, the system being adapted for establishing a communication link between the three devices.

FIG. 3 shows an embodiment of a listening system comprising a binaural hearing aid system and an auxiliary device in the form of an audio gateway, the system being adapted for establishing a communication link between the three devices. FIG. 3 shows an application scenario of an embodiment of a portable listening system according to the present disclosure, wherein the auxiliary device (AD) comprises an audio selection device adapted for receiving a multitude of audio signals (here shown from an entertainment device, e.g. a TV 52, a telephone apparatus, e.g. a mobile telephone 51, a computer, e.g. a PC 53, and an external microphone xMIC for picking up sounds xIS from the environment, e.g. the voice of another person). In the embodiment of FIG. 3, the microphone 11 of the audio gateway device (AD) is adapted for picking up the user's own voice 31 and capable of being connected to one or more of the external audio sources 51, 52, 53 via wireless links 6, here in the form of digital transmission links according to the Bluetooth standard as indicated by the Bluetooth transceiver 14 (BT-Rx-Tx) in the audio gateway device (AD). The audio sources and the audio gateway device may be paired using the button BT-pair. Once paired, the BT-address of the audio source may be stored in a memory of the audio gateway device for easy future pairing. The links to the audio sources may alternatively be implemented in any other convenient wireless and/or wired manner, and according to any appropriate modulation type or transmission standard, possibly different for different audio sources. Other audio sources than the ones shown in FIG. 3 may be connectable to the audio gateway, e.g. a dedicated audio delivery device (such as a music player, a telecoil, an FM-microphone or the like). The audio gateway device (AD) further comprises a selector/combiner unit (not shown in FIG. 3) adapted for allowing the selection of an appropriate signal or the combination of appropriate signals for transmission to the hearing instruments (HI-1, HI2) of the binaural hearing aid system. The intended mode of operation of the listening system can be selected by the user via mode selection buttons Mode1 and Mode2. Here Mode1 indicates e.g. a telephone conversation mode (where the audio signal from a currently actively paired mobile telephone is selected) and Mode2 indicates e.g. an entertainment device mode (where the audio signal from a currently actively paired entertainment device, e.g. the TV or a music player, is selected). The audio gateway device may further have the function of a remote control of the binaural hearing aid system, e.g. for changing program or changing operating parameters (e.g. volume, cf. Vol-button) in the hearing instruments, and/or for fully or partially powering the system down (or up).

The hearing instruments (HI-1, HI-2) each comprises a manually operable user interface (UI), whereby the user is allowed to change operating conditions of each individual (or both) hearing instruments by manual operation of the user interface (e.g. a push button), e.g. for changing program or operating parameters (e.g. volume) or for powering the devices (fully or partially) down or up (i.e. turning devices on or off).

The hearing instruments (HI-1, HI-2), are shown as devices mounted at the left and right ears of a user (U). The hearing instruments of the system of FIG. 3 each comprises a wireless transceiver, here indicated to be based on inductive communication (I-Rx). The transceiver (at least) comprises an inductive receiver (i.e. an inductive coil, which is inductively coupled to a corresponding coil in a transceiver (I-Tx) of the audio gateway device (AD)), which is adapted to receive the audio signal from the audio gateway device (either as a baseband signal or as a modulated (analogue or digital) signal, and in the latter case to extract the audio signal from the modulated signal). The inductive links 41 between the audio gateway device and each of the hearing instruments (HI-1, HI-2) are indicated to be one-way, but may alternatively be two-way (e.g. to be able to exchange control signals between transmitting (AD) and receiving (HI-1, HI-2) device, e.g. to agree on an appropriate transmission channel). Alternatively or additionally, the listening device (and/or the audio gateway device) may be adapted to receive an audio signal from a telecoil (T-coil) in the environment of the device and/or from an FM-transmitter (e.g. forming part of an external microphone, cf. e.g. xMIC if directly transmitted to the hearing instrument(s)).

The audio gateway device (AD) is shown to be carried around the neck of the user (U) in a neck-strap 42. The neck-strap 42 may have the combined function of a carrying strap and a loop antenna into which the audio signal from the audio gateway device is fed for better inductive coupling to the inductive transceiver of the listening device.

The hearing instruments (HI-1, HI-2) are further adapted to establish an interaural wireless link (IA-WL) (e.g. an inductive link) between them, at least for exchanging status or control signals between them, including at least the first control signal for performing a first action (e.g. a partial power down by entering a low-power mode).

Figure 4:
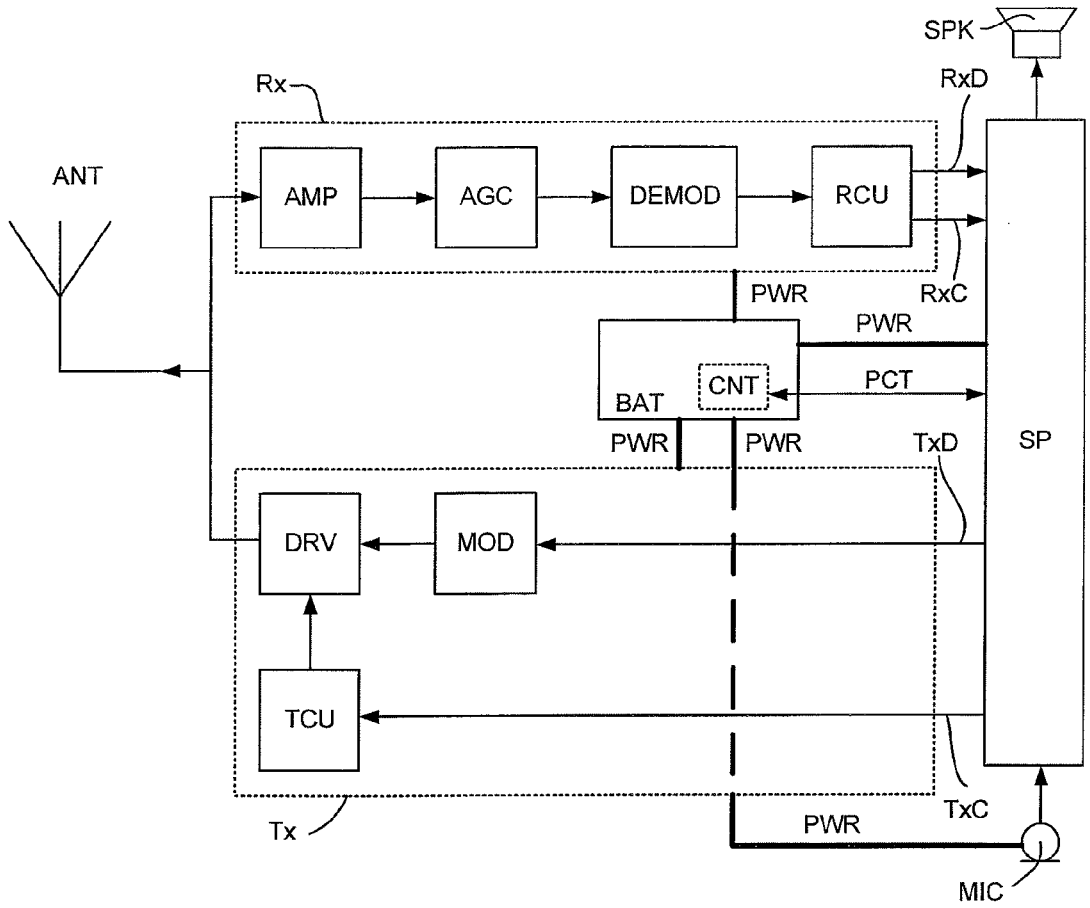
FIG. 4 shows an embodiment of a listening device according to the present disclosure.

FIG. 4 shows an embodiment of a listening device for use in a binaural listening system according to the present disclosure. The listening device of FIG. 4 comprises the same functional elements as described in connection with the embodiment of FIG. 1A:

- a forward path from a microphone (MIC) to loudspeaker (SPK), the forward path comprising a processing unit (SP);
- a battery (BAT) for energizing some or all of the functional components of the listening device;
- an antenna (ANT) and transceiver unit (Rx, Tx) for establishing a wireless link to an opposite listening device of a binaural listening system.

The receiver unit (Rx) comprises a gain stage, here comprising a first, fixed (pre-amplifying) gain stage (AMP) and a second, variable gain stage (AGC). The fixed gain stage (AMP) amplifies the input signal from the antenna (ANT) with a fixed gain value and provides an amplified output signal. The variable gain of the second stage (AGC) allows the receiver itself to set the gain to an appropriate value, ensuring the optimum signal level for the following processing circuits (here signal demodulating unit DEMOD). The gain stage may alternatively be fully fixed or fully variable. The demodulated (and possibly decoded) signal is fed to a receive control unit (RCU) (at least) for extracting first and second control signals from the demodulated input signal and for generally separating different types of signals, e.g. possible audio signals from (e.g. first and second) control signals (reflected in output signals RxD and RxC, respectively. The reception of a first and/or second control signal (RxC) may result in an action being performed in the listening device, here e.g. a control of the power supply of various parts of the listening device. The signal processing unit (SP) receiving the control signal RxC sends power control signal PCT to a control part (CNT) of the battery unit (BAT) for supplying power (current) to at least some of the functional components of the listening device, here in the form of power connections PWR to the receiver (Rx), transmitter (Tx), signal processing unit (SP and microphone unit (MIC). It may be relevant to be able to individually control other functional components than the ones shown in FIG. 4. Likewise, it may be relevant to be able to individually control different functional parts of the signal processing unit (SP), e.g. a feedback cancellation system, processing in the forward path, etc. The control part (CNT) of the battery unit (BAT), or alternatively or additionally, the signal processing unit (SP), is/are adapted to control the supply of power to the various functional parts/components of the listening device, e.g. by controlling the draw of current from the battery, e.g. by selectively opening or closing switches in conductors between the battery and the various functional parts/components in question.

The transmitter unit (Tx) receives data TxD to be transmitted from the signal processing unit (SP). The data to be transmitted may comprise an audio signal and/or a control signal (e.g. a first or second control signal). The data to be transmitted TxD are fed to a modulation unit (MOD) for modulating a carrier and/or applying a digital encoding scheme to the data. The modulated signal is fed to a driver (DRV) for driving the antenna (ANT). In parallel, the transmitter (Tx) receives a control signal TxC from the signal processing unit (SP) for controlling the power level (or transmission range) of the data to be transmitted. To this end, the transmitter (Tx) comprises a transmit control unit (TCU) (at least), which—based on the control signal TxC—controls the transmit power of the transmitter at a given point in time (via driver DRV). This allows the transmission of first data (including a first control signal) with a first level of transmission power providing a first operating transmission range (cf. $1^{st}$ Tx-range in FIG. 1A), and the transmission of second data (including a second control signal) with a second level of transmission power providing a second operating transmission range (cf. $2^{nd}$ Tx-range in FIG. 1A).

In an embodiment, the listening devices are adapted to enter a low-power mode (e.g. a sleep mode) when the distance between the first and second devices is small (within the $1^{st}$ Tx-range in FIG. 1A), where only control signals transmitted with low power are received.

In an embodiment, the listening devices are adapted to enter a microphone-off mode, in case the link is fully lost (i.e. where the distance between the first and second devices is larger than the maximum operating distance of the $2^{nd}$ Tx-range in FIG. 1A), e.g. in case the devices are taken off.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

[Schaub; 2008] Arthur Schaub, Digital hearing Aids, Thieme Medical. Pub., 2008.

US 2009/0087005 A1

US 2010/0184383 A1

The invention claimed is:

1. A binaural listening system, comprising:

first and second listening devices adapted for being located at or in respective left and right ears of a user, the first and second listening devices being adapted to establish a wireless link allowing an exchange of information between the listening devices, each listening device comprising a signal processing unit for processing a signal comprising audio and for performing logic actions based on one or more control inputs, and an antenna and transceiver unit for establishing said wireless link, the transceiver unit comprising a transmit control unit configured to set transmit power to a first level of transmission if first data containing a first control signal is to be transmitted and to transmit the first data with the first level of transmission power, the first level of transmission power providing a first operating transmission range and the transmit control unit configured to set the transmit power to a second level of transmission if second data is to be transmitted and to transmit the second data with the second level of transmission power, the second level of transmission power providing a second operating transmission range larger than said first operating transmission range, and a receive control unit configured to receive said first and second data from an opposite listening device, when said first and second listening devices are located within said first and second operating transmission ranges, respectively, wherein said transmit control units of said first and second listening devices are adapted to provide that said first data comprises the first control signal for performing a first action in said second and first listening device, respectively, said first action including powering down or up functional parts of the listening device, wherein said receive control units of said second and first listening devices are adapted to provide that said first control signal is extracted from said first data received from the respective opposite listening device, wherein said signal processing units of said second and first listening devices, respectively, are adapted to perform said first action based on said first control signal, and the transmit control units are configured to transmit said first control signal during a low-power mode as well as during a normal mode of operation of the binaural listening system, the binaural listening system consuming less power when operating in the low-power mode as compared to the normal mode.

2. A binaural listening system according to claim 1, wherein said transmit control units of said first and second listening devices are adapted to provide that said second data comprises a second control signal different from the first control signal for performing a second action in said second and first listening devices, respectively, and wherein said receive control units of said second and first listening devices are adapted to provide that said second control signal is extracted from said second data received from the respective opposite listening device, and wherein said signal processing units of said second and first listening devices, respectively, are adapted to perform said second action based on said second control signal.

3. A binaural listening system according to claim 2 wherein the second action comprises activating a normal mode of operation.

4. A binaural listening system according to claim 1 wherein said receive control unit of said second and first listening device is adapted to generate a third control signal in case said first control signal has not been received and extracted for a predefined time or according to a predefined scheme, and wherein said signal processing units of said second and first listening devices, respectively, are adapted to perform a third action based on said third control signal.

5. A binaural listening system according to claim 4 wherein the third action comprises activating a normal mode of operation.

6. A binaural listening system according to claim 1 wherein the first action comprises activating a specific mode of operation.

7. The binaural listening system according to claim 6, wherein the specific mode of operation is a microphone-off mode.

8. A binaural listening system according to claim 1, wherein the transmit control unit is adapted to provide that said first control signal is transmitted repeatedly on a first interval.

9. A binaural listening system according to claim 8, wherein the transmit control unit is adapted to provide that said second control signal is transmitted according to a second timing scheme.

10. A binaural listening system according to claim 1, wherein the first transmission range is smaller than a minimum distance at which the first and second listening devices are used in normal operation.

11. A binaural listening system according to claim 1, wherein the second transmission range is larger than a minimum distance at which the first and second listening devices are used in normal operation.

12. A binaural listening system according to claim 1 wherein the transmit control unit of said first and second listening device is adapted to send a first information signal to the second and first listening devices, respectively, when the first and second listening device, respectively, have received said first control signal.

13. A binaural listening system according to claim 12 wherein said signal processing units of said second and first listening devices, respectively, are adapted to perform said first action based on said first control signal and said first information signal received from their respective opposite listening devices.

14. A binaural listening system according to claim 1, wherein the first and second listening devices are authorized to allow an exchange of data between them.

15. The binaural listening system according to claim 1, wherein the transmit control units are configured to transmit the first data over an inductive coupling between adjacent inductor coils, and the transmit control units are configured to transmit the second data over a link based on radiated fields.

16. The binaural listening system according to claim 1, wherein the first and second listening devices are first and second hearing aids, respectively.

17. A method of operating a binaural listening system, the binaural listening system comprising first and second listening devices adapted for being located at or in respective left and right ears of a user, the first and second listening devices being adapted to establish a wireless link allowing an exchange of information between the listening devices, the method comprising:

processing a signal comprising audio and performing logic actions based on one or more control inputs;

establishing said wireless link;

setting a transmit power to a first level of transmission power providing a first operating transmission range if first data containing a first control signal is to be transmitted;

transmitting the first data with the first level of transmission power during a low-power mode as well as during a normal mode of operation of the binaural listening system, the binaural listening system consuming less power when operating in the low-power mode as compared to the normal mode;

setting the transmit power to a second level of transmission power providing a second operating transmission range larger than the first operating transmission range if second data is to be transmitted;

transmitting the second data with the second level of transmission power;

receiving said first and second data, when said first and second listening devices are located within said first and second operating transmission ranges, respectively;

providing that said first data comprises the first control signal for performing a first action in said second and first listening device, respectively, said first action including powering down or up functional parts of the listening device, wherein said first control signal is extracted from said first data received from the respective opposite listening device; and performing said first action based on said first control signal.

18. The method of operating a binaural listening system according to claim 17, wherein said transmitting the first data includes transmitting over an inductive coupling between adjacent inductor coils, and said transmitting the second data includes transmitting over a link based on radiated fields.

* * * * *